United States Patent [19]

Pietsch et al.

[11] 3,959,054

[45] May 25, 1976

[54] PROCESS FOR THE PRODUCTION OF TEXTILE FIBER FLEECES REINFORCED WITH EXPANDED NETTING

[76] Inventors: Helmut E. W. Pietsch, Danziger Platz 9; Horst Nicolaus, Waeschterstrasse 2, both of 85 Nurnberg, Germany

[22] Filed: June 17, 1974

[21] Appl. No.: 479,792

[30] Foreign Application Priority Data

June 5, 1973 Germany ..... 2328470

[52] U.S. Cl. ..... 156/148; 28/72 CS; 28/72 NW; 28/72.2 R; 156/163; 156/229; 156/252; 156/306; 428/103; 428/221; 428/227; 428/240; 428/288

[51] Int. Cl.[2] ..... B32B 3/26

[58] Field of Search ..... 156/148, 155, 229, 163, 156/160, 252, 296, 306, 309, 166, 167; 28/72 NW, 72.2 R, 73, DIG. 1, 72 CS; 161/80, 53, 154, 402; 428/102, 103, 221, 225, 227, 236, 237, 240, 283, 288

[56] References Cited

UNITED STATES PATENTS

| | | | |
|---|---|---|---|
| 3,428,506 | 2/1969 | Johnstone | 156/148 |
| 3,506,529 | 4/1970 | Sanders | 156/148 |
| 3,546,059 | 12/1970 | Isgur et al. | 156/148 |
| 3,619,339 | 11/1971 | Garrett | 156/148 |
| 3,627,605 | 12/1971 | Taylor | 156/148 |

FOREIGN PATENTS OR APPLICATIONS

| | | |
|---|---|---|
| 2,236,286 | 2/1973 | Germany |

*Primary Examiner*—Edward G. Whitby
*Attorney, Agent, or Firm*—Isler and Ornstein

[57] ABSTRACT

A process is disclosed in which a layer of textile fibers is applied to an expanded net formed from foils and consisting of two components, one of which is superimposed upon the other and one of which has a softening temperature substantially different from that of the other, and heating the layered structure thus formed to the softening temperature of the component having the lower softening temperature. The process is characterized by the fact that in forming the expanded net, the component having the lower softening temperature is spread sufficiently to cause it to tear into separate scales or flakes, some of which adhere to the higher melting component, and some of which adhere to the textile fibers.

4 Claims, 2 Drawing Figures

PROCESS FOR THE PRODUCTION OF TEXTILE FIBER FLEECES REINFORCED WITH EXPANDED NETTING

This invention relates to a process for the production of textile fiber fleeces reinforced with expanded netting, to be used mainly for the making of hygienic articles, such as sanitary napkins, diapers, hospital pads and the like.

It is known that such fleece materials should have good moisture permeability with sufficiently high strength, and, namely, both tensile strength and abrasion resistance. Moreover, both for economy and technical reasons, these have as low as possible an area weight (weight per surface unit) and must behave like typical textile materials in appearance and feel.

By textile fiber fleece materials are understood today in general and also in the following, sheet-like forms which consist of textile fibers, which are deposited in isotropic or anisotropic arrangement, and connected with each other, mechanically or chemically, and strengthened thereby. As textile fibers are understood, in general, organic fibers, which because of their length and their surface properties can be spun. As typical examples may be mentioned cotton, cellulose, wool, but also synthetic fibers, for example, polyamide, polyester, polyurethane, polyolefines and similar known substances.

The deposit of the fibers in isotropic or anisotropic arrangement may be done in various ways. The known methods may be classified into dry and wet processes; under the dry process may be mentioned, in particular, laying with the aid of carding and (carding), as well as depositing with the aid of gas (especially a stream of air) on a screen or perforated drum, and under the wet process, the deposit of the fibers in the paper-making manner, with the aid of a stream of water, on a screen.

For the strengthening of the deposited fibers, purely mechanical processes are known, such as sewing or needlework, as well as chemical processes. In the latter, either the thermoplastic properties or the swellability of the fibers themselves are utilized, or auxiliary substances, such as glues, for example, are added, which are for the purpose of binding the fibers together at the intersections. The choice of strengthening method is especially important to the properties of the fleece material produced, especially the typical textile properties, namely, feel, yield, softness, appearance, etc.

To improve the strength properties, especially the tear resistance of textile fiber fleeces, the working of reinforcing inlays into the material is known. The first attempts of this kind consisted of pressing the glue, used as binder, in a pattern, perhaps diamond-shaped, on the textile fiber layer, and in this way producing both a reinforcing skeleton and, at the same time, the necessary binding of the fibers with each other.

From German Published Application No. 1,149,325 is known the production of the reinforcing inlay to be introduced into the fleece by producing first a foil (film) of suitable material, and expanding this by stretching and possibly subsequent slitting to individual threads or thread-like forms. As suitable materials are mentioned polyamides, polyurethanes, polyesters and the like; but others, and particularly polyolefins, especially polyethylene or polypropylene, may be considered. According to the choice of the foil (film) as well as the pretreating and the degree of stretching, there can be produced in this way bundles of individual fibers, loosened from each other, or cohesive networks, which have a rhomboid structure similar to that described in German Pat. No. 844,789. The reinforcing inlays produced in this way can then be subjected, together with the textile fibers forming the fleece, under light pressure, to a heat treatment, the thermoplastic reinforcing inlays being partly melted and joining with the fibers of the fleece and so forming the fleece material.

The partial melting of the thermoplastic fibers leads, of course, to a weakening of the total structure and so, in particular, of the tensile strength. To avoid this disadvantage, a process has been described in German Disclosure No. 2,040,500, in which the joining between the expanded net and the fibers is produced with the aid of an additional melting glue. The amount of the melting glue is kept so slight, in this process, that a secure binding between net and fibers is attained, but no excess of melting glue is present, which would impair the textile properties of the finished article. The process described there is distinguished by the fact that the reinforcing inlays are first electrostatically charged, in a manner known per se, and then covered with powdered thermoplastic binder and then freed of excess powder by blowing air, beating, vibrating, or the like, and finally joined with one or more layers of unstrengthened or pre-strengthened fiber fleece by the action of heat and possibly light pressure. This process has proved good for the production of high-quality fleece materials, reinforced with expanded net; it is expensive, however, because of the additional work steps necessary.

A process is described, in German Disclosure 2,236,286, by which one additional work step, for the application of the thermoplastic binder can be omitted. It is proposed there that a fleece material be produced with several fiber nets, by doubling, the fiber nets consisting of a two-component foil, of which the components have softening or melting points lying sufficiently far apart so that it is possible to heat the doubled foil to a temperature at which only the lower-melting component softens, and effects the binding of the structure, while the high-melting component remains substantially unchanged. How far apart the melting or softening temperatures of the two components may lie will depend on the accuracy with which the heating apparatus present can heat the expanded net, covered with fibers, under the operating conditions to a desired temperature. The process has the advantage of simple execution, but presents the difficulty that the lower-melting binder component is on only one side of the foil lattice and consequently can effect a binding only on one side. Moreover, it has been found that because of the slight layer thickness of the binder components, for a secure adhesion of the fibers, an increased surface pressure must be applied which then, despite the higher softening point of the second component, causes the fibers to be pressed into the foil network, and there cause a certain weakening of the network.

With this state of the art, the problem exists of proposing a process for the production of textile fiber fleeces, reinforced with expanded net, in which a secure binding of the fibers to the expanded net, and not only on one side, is obtained, and in which it is assured that a cross section weakening of the expanded net, in the binding of the fibers to the net, does not occur.

To solve this problem, we start with the above-mentioned known process for the production of textile fiber fleece material, reinforced with expanded net. The process is carried out so that at least one layer of textile fibers is laid on a two-component expanded net, of which the two components have widely different softening points, and in which the layered structure is then heated to the softening temperature of the lower-softening component. In this process also a slight pressure may be applied, which should not exceed 10 kp/cm², however. The process is distinguished by the fact that a two-component expanded net is used, of which the lower-softening component, in the expansion of the foil to a net, is torn off with the forming of scales.

According to a preferred embodiment of the invention, a two-component expanded net is used, of which the expanded component consists of polypropylene, and the non-expanded component, torn to scales, consists of high-pressure polyethylene.

In the production of two-component foils, including those which are to be further processed to expanded nets, the components have always been chosen, up to now, so that they have about the same expansion behavior. This is necessary when an expanded net is to be produced which is to give a uniform impression visually, somewhat as represented in FIGS. 1 and 2 of German Disclosure 2,236,286.

According to the invention, there is intentional deviation from this, the only usual way up to now. Rather, for the solution of the problem set here, an expanded net is used, of a bi-component foil, of which the components have a completely different expansion behavior, namely, one so different that the one component, which may consist of polypropylene, for example, is expanded in the known way, but that, under the necessary conditions for this, the other component has already exceeded the limits of its tensile strength, and consequently falls apart, with the forming of scaly bits, which remain clinging to the expansible component. It has been observed that these scaly elements not only cling to the other component, in the manner of islands, but stand out from the latter in the form of fibers and so give two desired effects in the present connection; namely, on the one hand, they penetrate through the expanded foil network spatially and so can bind fibers on both sides of the network, and on the other hand, at the places where the scales are situated, they make binder available in greater amount than would be the case, if the components had been uniformly expanded and spread.

The invention is explained in detail below with reference to the attached drawing.

Figure 1:
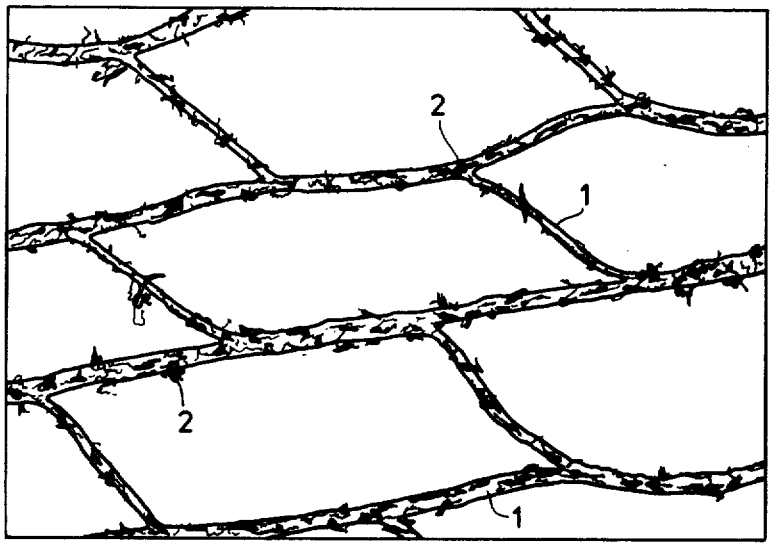
FIG. 1 is an enlarged section of an expanded and spread two-component foil to be used according to the invention.

The expanded net represented in FIG. 1 was produced from a two-component foil. The component 1 consisted of polypropylene and the component 2 of polyethylene. The two components have the following characteristic values:

| Component | Material | (spec. wt.) Density (g/cc.) | Tensile Strength (kp/cm²) | Melting Range (°C) |
|---|---|---|---|---|
| 1 | Polypropylene | 0.907 | 350 | 160–170 |

-continued

| Component | Material | (spec. wt.) Density (g/cc.) | Tensile Strength (kp/cm²) | Melting Range (°C) |
|---|---|---|---|---|
| 2 | Polyethylene | 0.918 | 90 | 105–110 |

FIG. 1 shows that the component 1 is expanded in the known way to a network. Component 2 has been torn into scales. The resultant scales cling only in part to the fibrils of component 1 and with the other part stand out spatially from the fibrils, so that they are distributed, statistically, in about the same way on both sides of the fibril network.

Figure 2:
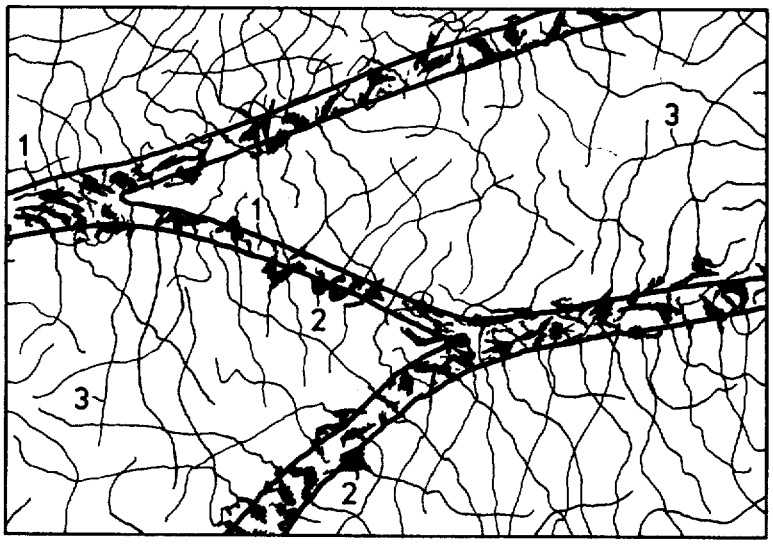
FIG. 2 is an enlarged section of a reinforced textile fiber fleece material produced with the use of the expanded net according to FIG. 1.

FIG. 2 shows a section from a textile fiber fleece material, which has been reinforced with the use of the fibril network shown in FIG. 1. It can be seen that the textile fibers 3 are glued, in each case, to the elements (bits) of the component 2, but without the fibrils of component 1 being changed in their form and thereby weakened.

The process according to the invention will also be explained in examples of execution easy to follow:

EXAMPLE 1

The raw material consisted of a bi-component foil of polypropylene and high-pressure polyethylene, with the components in the ratio 3:1. The components had the characteristic values given above.

To form an expanded net, the foil was stretched to about 850% of its original length and then fibrillated with the aid of a rotating needle cylinder. The component 2 (polyethylene) was torn up, forming scales, which according to FIG. 1 remain clinging to the fibrils of component 1.

The network produced in this way was now expanded by electrostatic charging and assembled with a textile fiber fleece, formed on the carding machine, from viscose rayon staple fibers 50 mm. long (1.5 denier) with an area weight of 10.2 grams per square meter.

The laminate was then conducted through a felting calander, of which the drum temperature was 110° C. and of which the pressing pressure lay below 10 kp/cm². The stay time of the laminate in the calander was about 5 seconds.

After cooling the laminate to room temperature, a sheet-like structure, reinforced with expanded net, according to FIG. 2, was present, which showed the following data:

| | |
|---|---|
| Area weight: | 21.1 grams per square meter |
| Tensile strength: (lengthwise) | 9.6 kp/200 mm. width of strip |
| Tensile strength: (crosswise) | 0.45 kp/200 mm. width of strip |

EXAMPLE 2

The same two-component foil as described in Example 1 was used. The stretching, fibrillation and expansion spreading took place in the same way.

After the expansion, there were added to the two-component expanded net, two carded fiber fleeces of viscose rayon staple fibers, of about 10 grams per square meter, one on each side. The laminate obtained was treated in the felting calander under the same conditions described in Example 1.

A sheet-like structure resulted, with the following data:

| | |
|---|---|
| Area weight: | 21.8 grams per sq. meter |
| Tensile strength: (lengthwise) | 14.3 kp/200 mm. width of strip |
| Tensile strength: (crosswise) | 0.7 kp/200 mm. width of strip |

EXAMPLE 3

To demonstrate the superiority of the fleece materials produced according to the invention, we started with a two-component foil, of which both components have about the same tensile strength. The data of the components were as follows:

| Component | Material | Density (g/cc.) | Tensile Strength (kp/cm²) | Melting Range (°C) |
|---|---|---|---|---|
| 1 | High-pressure polyethylene | 0.925 | 220 | 105–115 |
| 2 | Low-pressure polyethylene | 0.943 | 240 | 122–136 |

The foil was stretched in the same way and fibrillated with the aid of a rotating needle cylinder as described in Example 1. An expanded bi-component foil of completely homogenous appearance resulted; both components were expanded in the same way, without tearing, to a two-component network.

The two-component expanded net produced in this way was expanded (spread) by electrostatic charging, and assembled with a carded fiber fleece of viscose rayon staple fibers 50 mm. long (1.5 denier) with an area weight of 10.2 grams per square meter. The laminate was treated in the felting calander under the conditions described in Example 1. After cooling to room temperature, there was a sheet-like structure with the following data:

| | |
|---|---|
| Area weight: | 11.9 grams per square meter |
| Tensile strength: | 3.2 kp/200 mm. width of strip |

-continued

| | |
|---|---|
| (lengthwise) | |
| Tensile strength: (crosswise) | 0.16 kp/200 mm. width of strip |

Under the microscope it could be seen clearly that the fibrils of the expanded net were widened by squeezing and the cellulose fibers were pressed into them. There resulted in this way a foil network which was weakened by the forming of notches. The weakening was shown in the lower values of tensile strength.

Having described our invention we claim:

1. Process for the production of textile fiber fleece material reinforced with expanded net, said process comprising the steps of applying at least one layer of textile fibers onto a non-expanded layered structure formed from at least two thermally softenable lamina, one of which lamina is superimposed upon the other, and one of which lamina has a softening temperature lower than that of the other lamina, heating the layered structure to at least the softening temperature of the component having the lower softening temperature, tensioning the heated assembled structure so that the component having the higher softening temperature forms an expanded net and the component having the lower softening temperature is spread sufficiently to cause it to tear into separate scales or flakes, which scales or flakes adhere to the expanded net formed of the higher melting component, or adhere to the textile fibers.

2. The process, as defined in claim 1, wherein the higher temperature softening component of the assembled structure consists of polypropylene, and the lower temperature softening component consists of high pressure polyethylene.

3. The process, as defined in claim 1, wherein heating the layered structure is carried forth with the application of pressure generally not exceeding 10 kp/cm².

4. The process, as defined in claim 1, wherein the heated assembly during tensioning is also needled to facilitate formation of an expanded net from the higher softening component.

* * * * *